US010183685B2

(12) United States Patent
King et al.

(10) Patent No.: US 10,183,685 B2
(45) Date of Patent: Jan. 22, 2019

(54) VIRTUAL OMNIMOVER

(71) Applicant: Universal City Studios LLC, Universal City, CA (US)

(72) Inventors: Steven Morris King, Orlando, FL (US); Henry William Long, Burnaby (CA)

(73) Assignee: Universal City Studios LLC, Universal City, CA (US)

( * ) Notice: Subject to any disclaimer, the term of this patent is extended or adjusted under 35 U.S.C. 154(b) by 211 days.

(21) Appl. No.: 15/057,994

(22) Filed: Mar. 1, 2016

(65) Prior Publication Data

US 2016/0176421 A1 Jun. 23, 2016

Related U.S. Application Data

(60) Continuation of application No. 14/677,737, filed on Apr. 2, 2015, now Pat. No. 9,296,400, which is a division of application No. 11/847,612, filed on Aug. 30, 2007, now Pat. No. 9,014,965.

(51) Int. Cl.

| | |
|---|---|
| ***A63G 31/16*** | (2006.01) |
| ***B61L 23/14*** | (2006.01) |
| ***B61L 15/00*** | (2006.01) |
| ***B61L 23/16*** | (2006.01) |
| ***B61L 27/00*** | (2006.01) |
| ***B61L 3/16*** | (2006.01) |
| ***A63G 7/00*** | (2006.01) |

(52) U.S. Cl.

CPC ..... *B61L 3/16* (2013.01); *A63G 7/00* (2013.01); *B61L 15/0018* (2013.01); *B61L 23/14* (2013.01); *B61L 23/16* (2013.01); *B61L 27/0094* (2013.01); *A63G 31/16* (2013.01)

(58) Field of Classification Search

CPC ..... B61L 13/16; B61L 23/14

See application file for complete search history.

(56) References Cited

U.S. PATENT DOCUMENTS

| | | | | |
|---|---|---|---|---|
| 5,403,238 | A | 4/1995 | Baxter et al. | |
| 5,595,121 | A | 1/1997 | Elliiott et al. | |
| 6,109,568 | A | 8/2000 | Gilbert et al. | |
| 2002/0033637 | A1 * | 3/2002 | Fisher | B61L 3/125 303/20 |
| 2003/0106455 | A1 | 6/2003 | Weston | |

(Continued)

FOREIGN PATENT DOCUMENTS

EP 0005968 A2 12/1979

OTHER PUBLICATIONS

WO Search Report from corresponding PCT Application No. PCT/US08/066722 dated Jun. 19, 2009.

*Primary Examiner* — Imran K Mustafa

(74) *Attorney, Agent, or Firm* — Fletcher Yoder P.C.

(57) ABSTRACT

A ride control system for controlling a plurality of vehicles on a path includes a path processor and a bi-directional voting circuit in circuit with the path processor. Each vehicle of the plurality of vehicles may include a vehicle processor supported by the at least one vehicle and shunt relays in circuit with the at least one vehicle processor. Each vehicle processor may be configured to close a respective shunt relay upon a predetermined condition of the vehicle whereby the bi-directional voting circuit is activated to notify all other vehicles.

20 Claims, 6 Drawing Sheets

(56) References Cited

U.S. PATENT DOCUMENTS

| | | | | |
|---|---|---|---|---|
| 2005/0247231 | A1* | 11/2005 | Fischer | B61L 23/00 104/3 |
| 2006/0085107 | A1 | 4/2006 | Hoffmann et al. | |
| 2007/0219681 | A1* | 9/2007 | Kumar | B61L 3/006 701/19 |

* cited by examiner

VIRTUAL OMNIMOVER

CROSS REFERENCE TO RELATED APPLICATIONS

This application is a continuation of U.S. application Ser. No. 14/677,737, filed Apr. 2, 2015, which is a divisional of prior U.S. application Ser. No. 11/847,612, filed Aug. 30, 2007, now U.S. Pat. No. 9,014,965, the specifications of which are incorporated herein by reference in their entirety for all purposes.

BACKGROUND OF THE INVENTION

Field of the Invention

The subject matter described herein relates generally to devices and methods for monitoring motion of a vehicle and, more particularly, to monitoring vehicle motion on a path.

Related Art

Currently, the monitoring of vehicle motion along a path, such as a railway or a track, is carried out using a central controller or computer. The computer monitors each vehicle's position on the track and when vehicle spacing is within a predetermined minimum distance, all vehicles on the track are stopped. Such a system, in addition to the computer, includes multiple sensors mounted at various locations along the track and complex wiring for connecting each sensor and the computer. Because of the necessary computer, complex wiring, and multiple sensors, the system is difficult to integrate and to costly to maintain. Other disadvantages include the requirement to test and prove system functionality after track installation, the technical challenge of aligning a sensor and target for the vehicle to track interface, the inability to sense a spacing problem until it has become sufficiently severe to violate the minimum spacing, and the inability to change spacing criteria without adding additional sensors which makes the system less flexible.

Accordingly, it is now desired to reduce cost and eliminate the above-described disadvantages of a centrally controlled system.

BRIEF DESCRIPTION OF THE INVENTION

In accordance with an embodiment of the present invention, a ride control system for controlling a plurality of vehicles on a path, comprises a path processor, a bi-directional voting circuit in circuit with the path processor, communication between processors, and a busbar for conducting electrical signals along the path. Each vehicle of the plurality of vehicles may comprise a vehicle processor supported by the at least one vehicle and a voting shunt relay in circuit with the path processor and other vehicle processors. Each vehicle processor may be configured to close a respective shunt relay upon a predetermined condition of the vehicle whereby the bi-directional voting circuit is activated to notify all other vehicles. Vehicle processors may communicate with other vehicle processors or a master processor via communication to initialize or maintain positions along the path.

In another aspect of the present invention a vehicle control system for a vehicle movable along a path comprises a vehicle energizing and stopping system, at least a portion of which is mounted to each vehicle, and a vehicle sensor system. The vehicle sensor system is mounted to each vehicle and in circuit with the vehicle energizing and stopping system. The vehicle sensor system is configured to determine an actual location of a particular vehicle while the vehicle is moving along the path and compare the actual location to a range of predicted locations. The vehicle sensor system may be further configured to signal the vehicle energizing and stopping system to stop all vehicles on the path where the actual location of the particular vehicle is outside the range of predicted locations.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a system and a method for energizing, stopping, and monitoring a location of vehicles on a path. One particular embodiment of the system includes a vehicle energizing and stopping system, at least a portion of which is mounted to each vehicle, and a vehicle sensor device that is mounted to each vehicle and in circuit with the vehicle energizing and stopping system.

Figure 1:
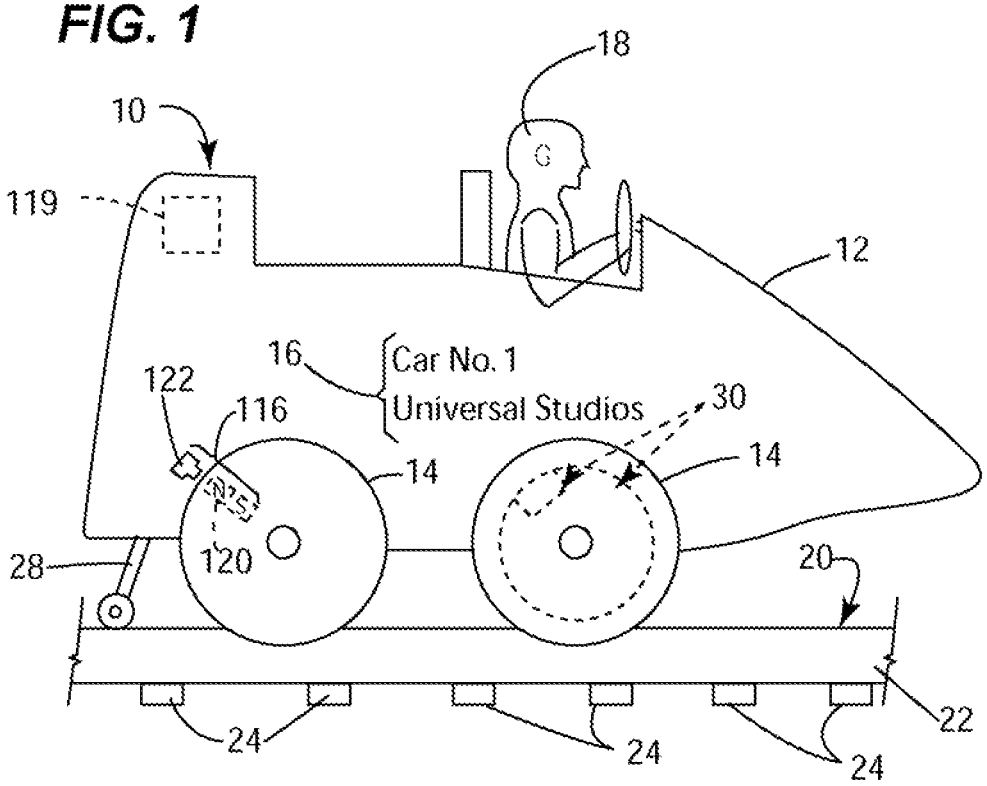
FIG. 1 is a diagram showing one vehicle disposed on a portion of a path and wherein the vehicle includes a vehicle control system in accordance with one embodiment of the present invention.
Figure 2:
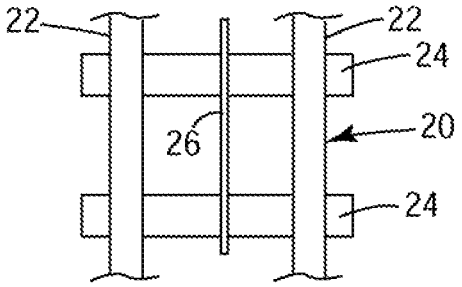
FIG. 2 is a diagram showing a top view of a portion of the path of FIG. 1

Referring to FIGS. 1 and 2, one vehicle 10, out of a plurality of vehicles of a ride system, is shown with a body 12, wheels 14 and appropriate indicia 16 along with a guest 18 seated therein. The vehicle 10 is disposed on a path such as a track which includes rails 22 that are supported by cross beams 24. A bus bar or energizing rail 26 provides electrical energy from an electrical generator (described below) to the vehicle 10 through means of an electrode 28. A disc brake 30 is shown mounted to a wheel 14.

Figure 6:
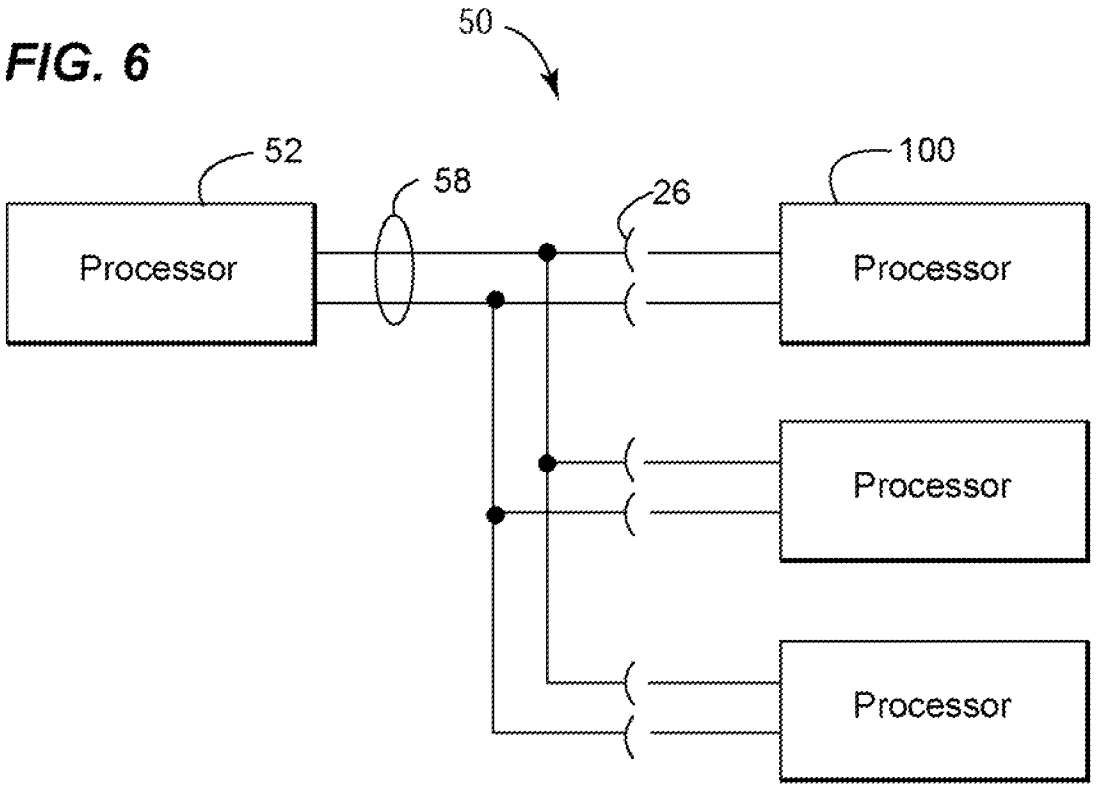
FIG. 6 is a schematic diagram of a ride control system in accordance with one embodiment of the present invention.

Referring now to FIG. 6, a schematic diagram showing a ride control system in accordance with one embodiment of the present invention is shown generally at 50. As shown, the ride control system 50 comprises a path or track processor 52 which is in circuit with the energizing rail 26 comprising a number of circuit connections (not numbered) and a plurality of vehicle control systems 100 each being located with a vehicle 10 (FIG. 1). It will be appreciated that in an optional embodiment (not shown), the track processor 52 may communicate via wireless communications with each vehicle control system 100, rather than via the energizing rail 26. The track processor 52 may comprise a programmable logic controller and monitors track functions such as mode of the track machine, stopping and starting functions, and control of all track-switching elements via fail-safe signals. The track processor 52 and each vehicle control system 100 may communicate to ensure the mode of the track machine is safely controlled for the all vehicles mounted to the track. If there is disagreement of the mode of the track or if the vehicle senses itself out of range for position, velocity, or acceleration parameters or other fault conditions, the vehicle will communicate to the track processor and/or other vehicle processors to cause a stop or other reaction for each vehicle 10.

The track processor may also be configured to determine and broadcast an ideal location of each vehicle to each vehicle on the path according to some predetermined plan such as every vehicle is spaced equally along the path. Each vehicle may then synchronize or vary its position along the path by increasing velocity or braking to correct its spacing from other vehicles.

Figure 7:
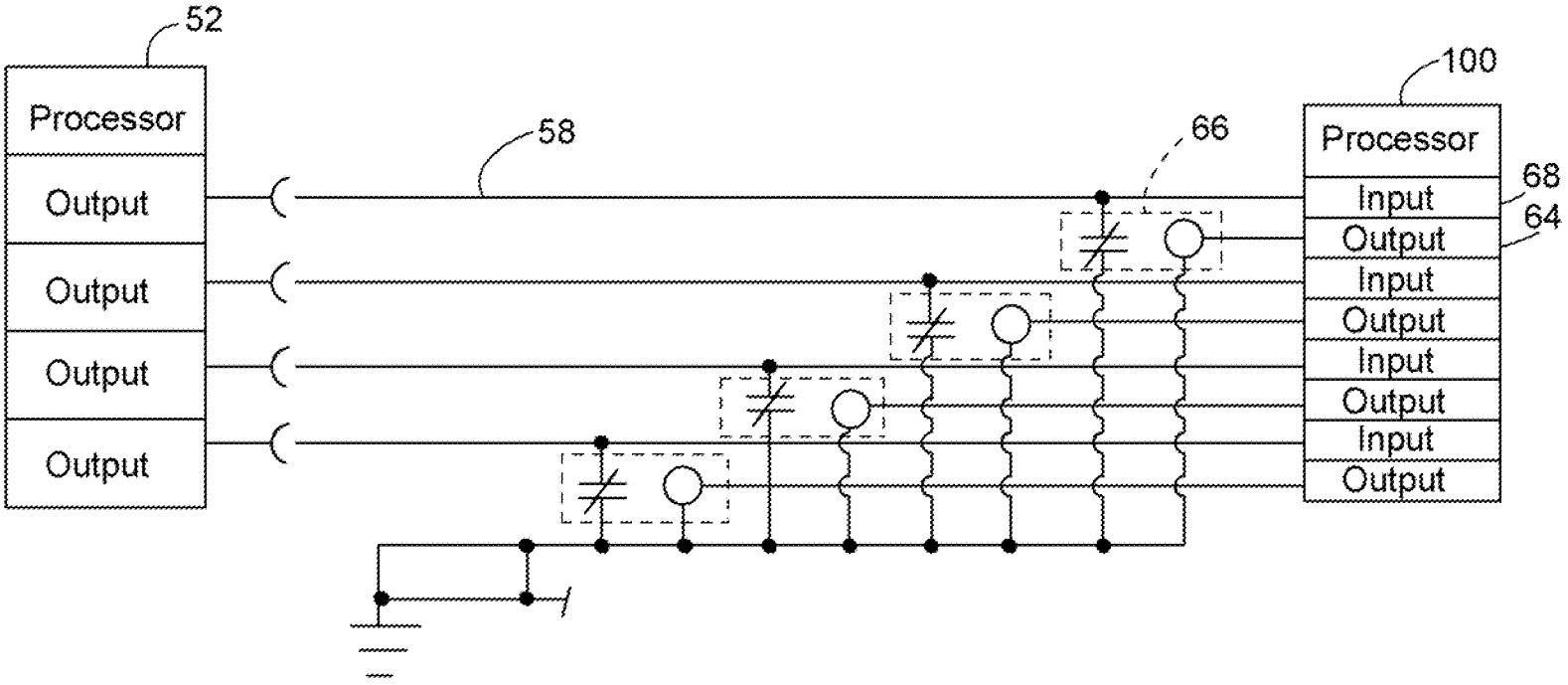
FIG. 7 is a schematic diagram showing further details of the ride control system of FIG. 6.

As shown in greater detail in FIG. 7, the track processor 52 may be connected in circuit with a bi-directional voting circuit 56 (FIG. 4) comprising a number of semiconductor gates arranged in a known manner, the function of which is described in more detail below and dual outputs 58 for bus bar control signals used to define the mode of the track machine, monitored by a plurality of vehicles. Each vehicle control system 100 may comprise an output switch controller 64 for energizing a shunt relay 66 and an input 68 for analog and/or digital signals sent from the track processor 52. A load resistor (not shown) may also be employed to provide a known load for one vehicle to the track processor 52 so that the number of vehicles can be defined by the value of the analog input (not shown).

Figure 3:
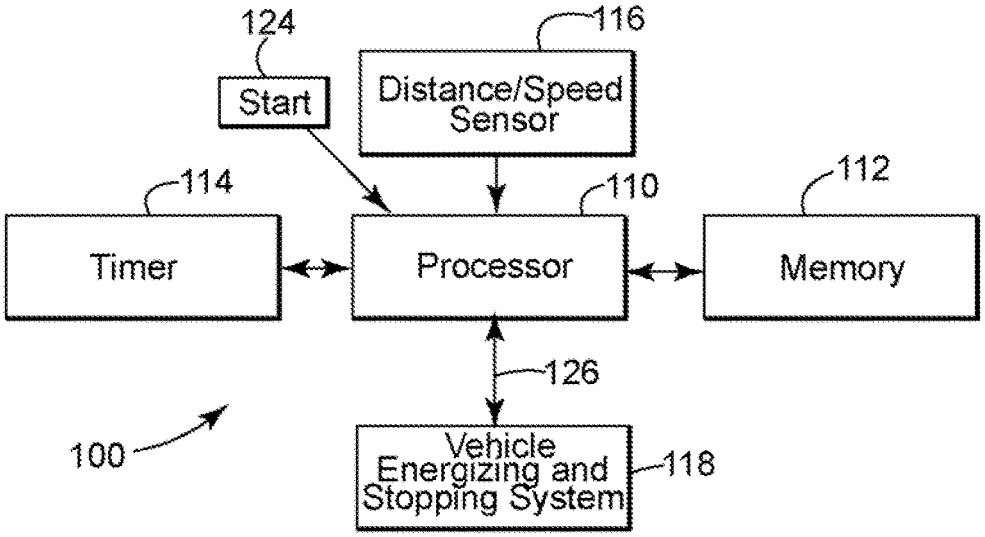
FIG. 3 is a block diagram showing details of the vehicle control system of FIG. 1.

As illustrated in FIG. 3, one embodiment of a vehicle control system for energizing, stopping and monitoring a location of a vehicle on a path in accordance with the present invention is illustrated generally at 100. In this embodiment, the control system 100 comprises a processor 110, a memory 112, a timer 114, a distance/speed sensor 116 and a vehicle energizing and stopping system 118. The processor 110, memory 112, timer 114, distance/speed sensor 116 and a portion of the vehicle energizing and stopping system 118 may be located in a compartment 119 located in the vehicle 10.

The processor 110 may be any suitable processor such as a programmable logic controller. The memory 112 may be any suitable type including but not limited to RAM, ROM, EPROM, and flash.

The memory 112 may store a program for the processor 110 and store a look up table for a predicted range of locations given a duration that a vehicle 10 is traveling along the track 20.

The timer 114 provides a timing function that may be used by the processor 110 to time an actual duration that the vehicle 10 is traveling along the track 20.

The distance/speed sensor 116 may comprise a magnet 120 and a magnetic field or optical sensor 122 which together function in a known manner to provide electrical pulses to the processor 110 which correspond to a distance traveled by the wheel 14. Optionally, other sensors such as a multi-turn encoder may be employed. To determine the distance the pulses may be counted or directly measured by the processor 110 to determine a distance and, therefrom, a location of the vehicle 10 along the track 20. It will be appreciated that the distance/speed sensor 116 may also comprise known pulse shaping circuitry.

The processor 110 is configured, via any suitable means such as software or firmware, to receive an initial signal from a start indicator 124 that the vehicle 10 has started traveling along the track 20 and thereafter, to continuously, or at regular intervals, calculate an actual location for the vehicle along the track as described above. The processor 110 is further configured to look up a predicted range of locations for the vehicle 10 along the track 20 based, e.g., on the duration from the timer 114 and compare that with the actual location. Where the actual location falls outside of that range of predicted locations, the processor 110 sends a signal along line 126 to the energizing and stopping system 118 which, as described in more detail below, is configured to stop the vehicle 10 from any further progress along the track 20 along with the progress of any other vehicles traveling along the track. Further, the processor 110 may be configured to receive an ideal location from the track processor 52 and compare its location to the ideal location and either brake or not brake, as described below, to thereby increase vehicle velocity to compensate.

Figure 4:
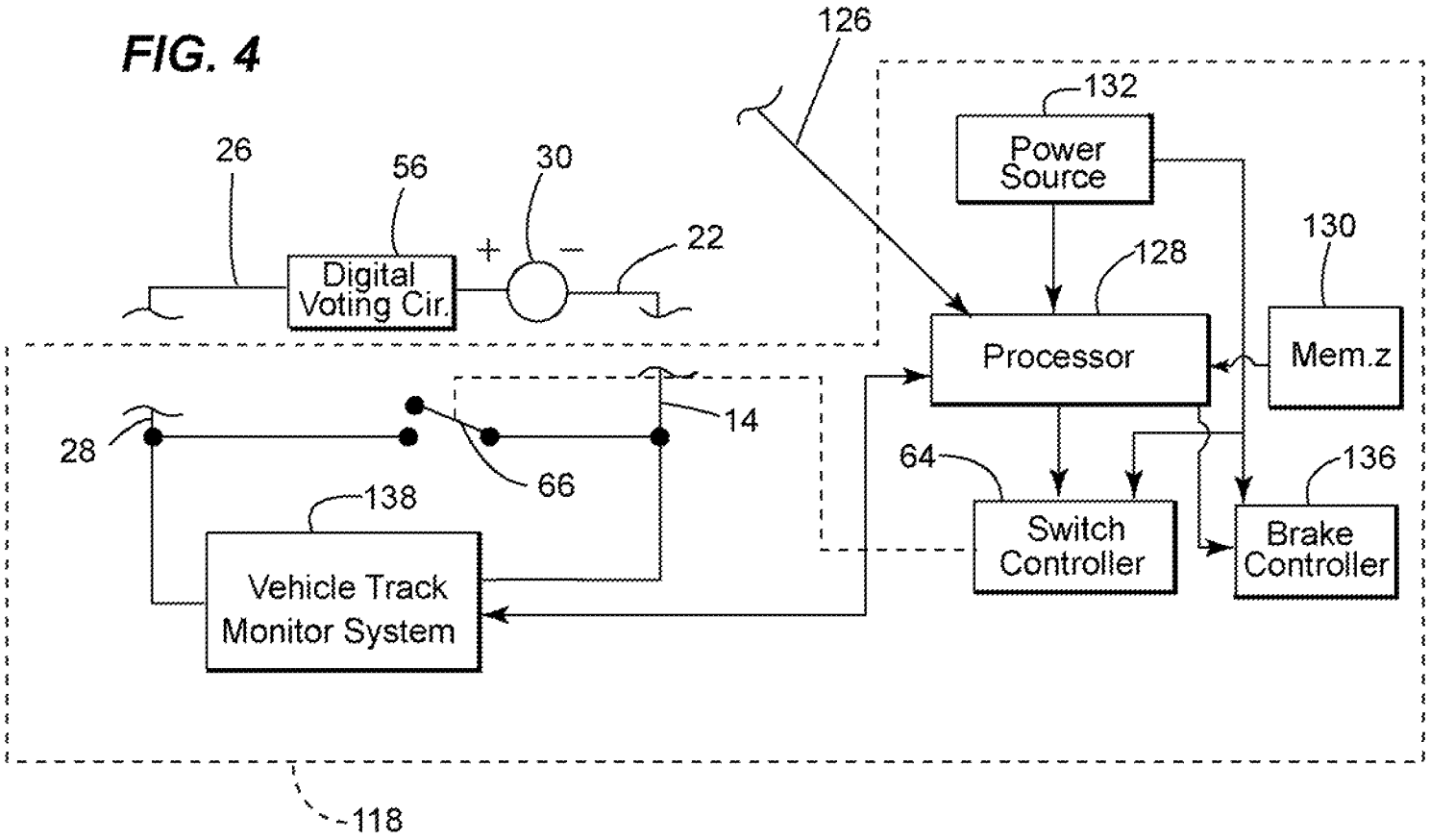
FIG. 4 is a diagram showing further details of the vehicle control system of FIG. 3.

One embodiment of an energizing and stopping system 118 suitable for use in the practice of the present invention is shown in FIG. 4. As shown, the energizing and stopping system 118 comprises a processor 128 interconnected with a memory 130, a power source 132, the output switch controller 64 (see also FIG. 7), a brake controller 136 and a vehicle track monitor 138.

The processor 128 may be similar to the processor 110 described above in connection with FIG. 3, or, in one optional embodiment, instead of two separate processors 110 and 128, it will be appreciated that both may be combined together as one processor that performs functions described herein for both processors.

Likewise, the memory 130 may be similar to the memory 112 described above and may function to store a program for configuring the processor 128.

The power source 132 may be any suitable power source such as a battery, generator or transformer. Optionally, the power source 132 may omitted and/or transform power received via the electrode 28. The power source 132 may provide sufficient electrical energy for energizing both the output switch controller 64 and the brake controller 136 which may be mounted to the brake 30 (FIG. 1).

Referring now also to FIGS. 1 and 2, the vehicle track monitor 138 may be any suitable device for monitoring energy output along the energizing rail 26 and, upon absence of the energy notifies processor 128. In an optional embodiment, the vehicle track monitor may also comprise an electrical motor (not shown) for driving the vehicle 10. The vehicle track monitor 138 is connected via the electrode 28 to the energizing rail 26 and through wheels 14 to a rail 22. An electrical generator 30 may be connected in circuit between the electronically controlled circuit breaker 56, connected to the energizing rail 26, and a rail 22. The shunt relay 66 (see also FIG. 7) that is normally closed may be in circuit between the electrode 28 and the wheel 14 and may be operated remotely by the switch controller 64.

In operation, the processor 128 may be configured, via, e.g., software or firmware, to respond to a command signal from the processor 110 to stop movement of the vehicle 10 by notifying the brake controller 136 to apply the brake 30. At the same time, the processor 128 may be further configured to notify the output switch controller 64 to close shunt relay 66 to short the generator 30 and alert the bi-directional voting circuit 56 so that other vehicles traveling on the track 20 will be notified that stopping is required via each vehicles' vehicle track monitor system 138. The processor 128 may also be configured to review the current speed and apply the brake 30 where necessary as described above to correct when an error in position on the track 20 is identified as described above. When the error in position is above a predetermined threshold position such as greater than five feet or, for example, within five feet of another vehicle, then the processor 128 may then alert the bi-directional voting circuit 56 so that other vehicles traveling on the track 20 will be notified that stopping is required.

Figure 5:
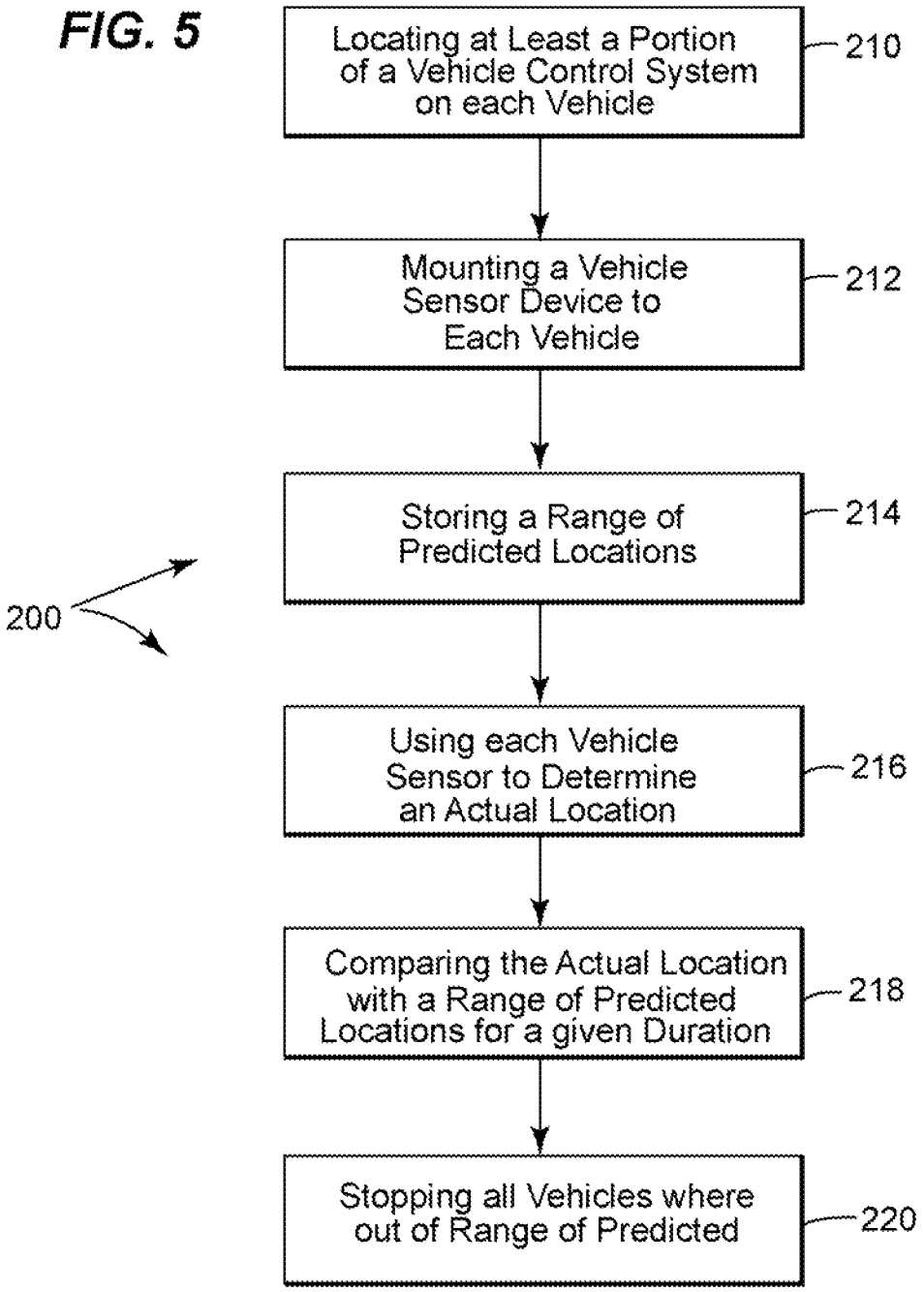
FIG. 5 is a flow chart showing a method of energizing, stopping and monitoring location of a plurality of vehicles along a path in accordance with another embodiment of the present invention.

A method of monitoring and controlling location of a plurality of vehicles movable along a path in accordance with another embodiment of the present invention is illustrated generally at 200 in FIG. 5. As shown at 210, the method comprises locating at least a portion of a vehicle control system on each vehicle, and as shown at 212, mounting a vehicle sensor device to each vehicle. The method also includes storing a range of predicted locations along the path for a given durations that each vehicle is on the path as shown at 214 and, as shown at 216, using each vehicle sensor to determine an actual location of each vehicle while the vehicle is moving along the path. Further, as shown at 218, the method comprises comparing the actual location of each vehicle to the range of predicted locations for a number of given durations and, as shown at 220, stopping all vehicles where any actual location is outside the range of predicted locations.

Technical effects of the herein described systems and methods include determining a location of a vehicle on a track. Other technical effects include determining whether the location is within a range of predicted locations.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A ride control system, comprising:

a memory storing data indicative of predetermined location ranges along a track for a vehicle of a plurality of vehicles, wherein each predetermined location range is associated with a corresponding time value; and a processor configured to:

access a predetermined location range for the vehicle associated with a current time value from the memory storing the data indicative of the predetermined location ranges for the vehicle;

receive data from a sensor disposed on the vehicle, the data indicative of an actual location of the vehicle at the current time value;

compare the data indicative of the actual location with the data indicative of the predetermined location range associated with the current time value; and instruct an energizing and stopping system of the vehicle to make adjustments to a power supply and/or braking of the vehicle based on results from comparing the data indicative of the actual location with the data indicative of the predetermined location range.

2. The ride control system of claim 1, wherein the data indicative of the actual location is associated with the current time value.

3. The ride control system of claim 2, wherein the current time value is determined based on data from a timer that starts at a start of travel of the vehicle.

4. The ride control system of claim 2, wherein the processor is configured to compare the data indicative of the actual location and the data indicative of the predetermined location range associated with the current time value to facilitate adjustment of the energizing and stopping system.

5. The ride control system of claim 1, wherein the processor is configured to instruct an electronically controlled circuit breaker to disable movement of each of the plurality of vehicles when a malfunction is identified in any one of the plurality of vehicles.

6. The ride control system of claim 5, wherein the processor is configured to identify the malfunction by determining that the actual location of the vehicle of the plurality of vehicles is outside of the predetermined location range for the vehicle.

7. The ride control system of claim 1, wherein the sensor comprises an optical sensor or a magnetic sensor.

8. The ride control system of claim 1, wherein the processor is configured to receive a corresponding time value and convert the corresponding time value to a location value based on a lookup table stored in the memory.

9. A ride vehicle, comprising:

a location sensor configured to detect indicators of an actual location of the ride vehicle along a track;

a memory storing data indicative of predetermined location ranges along the track for the ride vehicle, wherein each predetermined location range is associated with a corresponding time value;

a processor configured to:

receive data indicative of the actual location from the location sensor; and compare the data indicative of the actual location with data indicative of a predetermined location range of the ride vehicle associated with a current time value; and an energizing and stopping system configured to make adjustments to a power supply and/or braking of the ride vehicle based on results from comparing the data indicative of the actual location with the data indicative of the predetermined location range.

10. The ride vehicle of claim 9, wherein the energizing and stopping system is configured to close a shunt relay such that power is not supplied from a power source to the ride vehicle.

11. The ride vehicle of claim 9, wherein the ride vehicle comprises a vehicle motor configured to pull the ride vehicle along the track.

12. The ride vehicle of claim 9, wherein the data indicative of the actual location is associated with the current time value.

13. The ride vehicle of claim 9, wherein the processor is configured to access the memory to obtain the predetermined location range for the ride vehicle associated with the current time value from the memory storing the data indicative of the predetermined location ranges for the ride vehicle.

14. The ride vehicle of claim 9, wherein the processor is configured to wirelessly receive the data indicative of the predetermined location range of the ride vehicle.

15. A ride control system for controlling a plurality of vehicles on a path, comprising:

a plurality of vehicles respectively configured to travel along a path, each vehicle of the plurality of vehicles comprising:

a location sensor; and a vehicle control system;

a memory storing data indicative of predetermined location ranges along the path for each vehicle of the plurality of vehicles, wherein each predetermined location range for a vehicle is associated with a corresponding time value; and a processor configured to:

access a predetermined location range for each vehicle associated with a current time value from the memory storing the data indicative of the predetermined location ranges for each vehicle;

receive data from the location sensor of each vehicle, the data indicative of an actual location of the vehicle;

compare the data indicative of the actual location of each vehicle with the data indicative of the predetermined location range of each vehicle associated with the current time value; and instruct a vehicle control system of an individual vehicle of the plurality of vehicles to make adjustments to a power supply and/or braking of the individual vehicle based on results from comparing the data indicative of the actual location with the data indicative of the predetermined location range.

16. The ride control system of claim 15, wherein the processor is configured to make adjustments to the power supply and/or braking of the individual vehicle to adjust a spacing of the individual vehicle relative to other vehicles of the plurality of vehicles.

17. The ride control system of claim 15, wherein the processor is configured to make adjustments to the power supply to cause the individual vehicle to travel with increased velocity.

18. The ride control system of claim 15, wherein the processor is configured to make adjustments to the braking system to cause the individual vehicle to travel with decreased velocity.

19. The ride control system of claim 15, wherein the processor is configured to make adjustments to the power supply and/or braking of the plurality of vehicles to adjust a spacing of the plurality of vehicles relative to one another.

20. The ride control system of claim 15, wherein the processor is configured to instruct an electronically controlled circuit breaker to disable movement of each vehicle of the plurality of vehicles when a malfunction is identified in any one of the plurality of vehicles.

* * * * *